US006155865A

United States Patent [19]

Abe

[11] Patent Number: 6,155,865

[45] Date of Patent: Dec. 5, 2000

[54] INSULATION DISPLACEMENT CONTACT TERMINAL

[75] Inventor: Kimihiro Abe, Shizuoka-ken, Japan

[73] Assignee: Yazaki Corporation, Tokyo, Japan

[21] Appl. No.: 09/369,881

[22] Filed: Aug. 9, 1999

[30] Foreign Application Priority Data

Aug. 10, 1998 [JP] Japan ..... 10-226234

[51] Int. Cl.[7] ..... H01R 4/24

[52] U.S. Cl. ..... 439/397; 439/399

[58] Field of Search ..... 439/397, 399, 439/406, 407

[56] References Cited

U.S. PATENT DOCUMENTS

| | | | |
|---|---|---|---|
| 4,940,425 | 7/1990 | Hass et al. | 439/397 |
| 4,983,130 | 1/1991 | Caveney et al. | 439/407 |
| 5,934,927 | 8/1999 | Nagai | 439/397 |
| 5,980,300 | 11/1999 | Okabe | 439/397 |

FOREIGN PATENT DOCUMENTS 62-150868 9/1987 Japan .

*Primary Examiner*—Paula Bradley
*Assistant Examiner*—Tho D. Ta
*Attorney, Agent, or Firm*—Finnegan, Henderson, Farabow, Garrett & Dunner, L.L.P.

[57] ABSTRACT

An insulation displacement contact terminal has a pair of side walls, an a pair of pressure contact blades that are mutually opposing and formed by partial bending away from the side walls. When an insulated wire is inserted between the pressure contact blades along a first direction, edges of the pressure contact blades bite into the insulation of the insulated wire so as to make contact with the inner core wire of the insulated wire. The pressure contact blades each have a curved part that is continuous from the side walls, and each curved part has a radius of curvature such that when the pressure contact blades are bent from the side walls and when a pulling force is applied to the insulated wire in a second direction that intersects with the first direction, concentration of bending stress acting on the pressure contact blades is relieved.

15 Claims, 3 Drawing Sheets

INSULATION DISPLACEMENT CONTACT TERMINAL

BACKGROUND OF THE INVENTION

The present invention relates to an insulation displacement contact terminal.

In related art that was disclosed in the Japanese Utility Model Application Laid-Open Publication S62-150868, an insulation displacement contact terminal has a pair of side walls that are in mutual opposition, pressure contact blades that are mutually opposing and that are bent from the side walls so as to be approximately perpendicular thereto, and a slot that is defined between the pressure contact blades. In this insulation displacement contact terminal, when an insulated wire is inserted by pressure into the slot, the pressure contact blades bite into the insulation part of the insulated wire, thereby making electrical connection with the core wire within the insulation.

In the above-noted insulation displacement contact terminal, however, because the pressure contact blades are bent so as to be substantially perpendicular from the side walls, there is a possibility of a crack or the like developing at the point of bending. Additionally, when the insulated wire is pulled so that the pulling force acts on the pressure contact blades, there is a concentration of bending stress at the bent part, this leading to the possibility of a great widening of the slot. If the slot is greatly widened, there is a decrease in the holding force on the insulated wire and also a decrease in the contact force between the pressure contact blades and the core wire therewithin, thereby causing a decrease in mechanical and electrical reliability.

SUMMARY OF THE INVENTION

Accordingly, it is an object of the present invention to improve on the above-noted drawbacks in the related art, by providing an insulation displacement contact terminal that prevents an expansion of the slot when a pulling force acts on the insulated wire, thereby maintaining a good mechanical and electrical connection between the pressure contact blades and the insulated wire.

In order to achieve the above-noted object, the present invention adopts the following basic technical constitution.

Specifically, the first aspect of the present invention is an insulation displacement contact terminal that has a pair of side walls, and a pair of mutually opposing pressure contact blades that are each partially bent from the side walls. When an insulated wire is inserted along a first direction between the pressure contact blades, the edges of the pressure contact blades bit into the insulation part of the insulated wire, thereby making contact with the core wire therewithin. The pressure contact blades have a curved part that continues from the side walls. When the pressure contact blades are bent from the side walls and when the insulated wire is pulled in a direction that intersects the first direction, these curved parts serve to relieve the concentration of bending stress that acts on the pressure contact blades.

With the above-described configuration, when the pressure contact blades are bent from the side walls, the curved parts of the side walls serve to relieve the concentration of stress that acts on the pressure contact blades. For this reason, when bending occurs, cracks do not develop and a drop in strength of the pressure contact blades is prevented. When the insulated wire is pulled in the second direction, the curved parts serve to relieve the concentration of bending stress that acts on the pressure contact blades, the result being that, even if the insulated wire is pulled, deformation which makes the spacing between the pressure contact blades larger does not occur.

Thus, in addition to an improvement in the force that with which the pressure contact blades hold the insulated wire, there is a great contact force that acts between the pressure contact blades and the core wire of the insulated wire.

The second aspect of the present invention is an insulation displacement contact terminal that has a contact part that makes contact with a mating contact, a pair of side walls, and a pair of mutually opposing pressure contact blades that are each partially bent from the side walls. When an insulated wire is inserted along a first direction between the pressure contact blades, the edges of the pressure contact blades bite into the insulation part of the insulated wire, thereby making contact with the core wire therewithin. The boundary between the curved parts and the side walls are disposed on the opposite side from the contact part with respect to the edges of the pressure contact blades.

With the above-noted configuration, the boundaries (pivot points) between the curved parts and the side walls are positioned on the opposite side of the pressure contact blades with respect to the edges of the pressure contact blades. For this reason, when the insulated wire is pulled in a direction that is opposite from the contact part, so that the edges (points of application) deform in the pulling direction, the edges bite even more deeply into the insulation of the insulated wire, the result being an improvement in the holding force on the insulated wire by the pressure contact blades, and the achievement of great contact force between the pressure contact blades and the core wire of the insulated wire.

DESCRIPTION OF THE PREFERRED EMBODIMENTS

Preferred embodiments of the present invention are described in detail below, with reference to relevant accompanying drawings.

Figure 1:
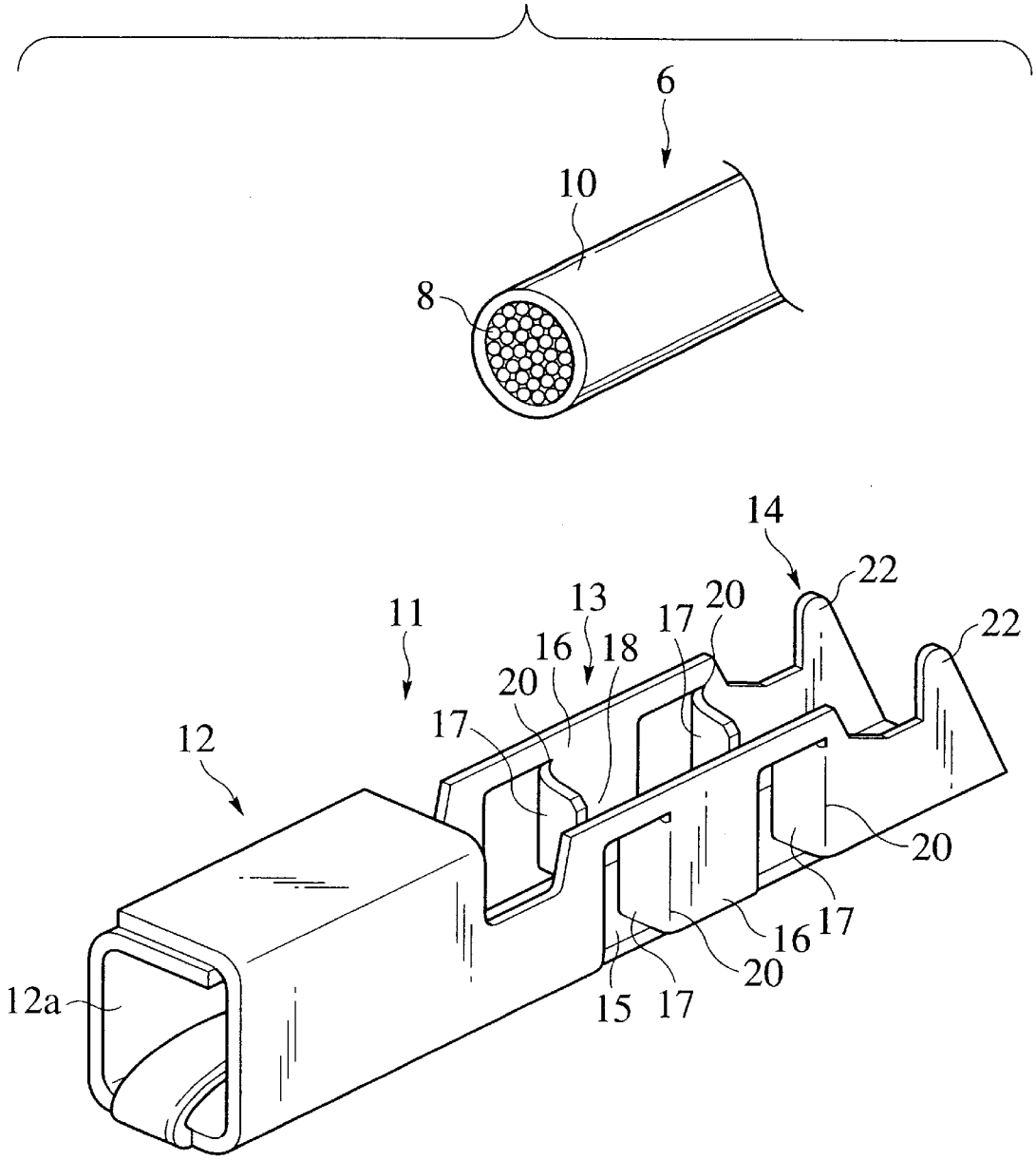
FIG. 1 is a perspective view that shows the first embodiment of the present invention.
Figure 2:
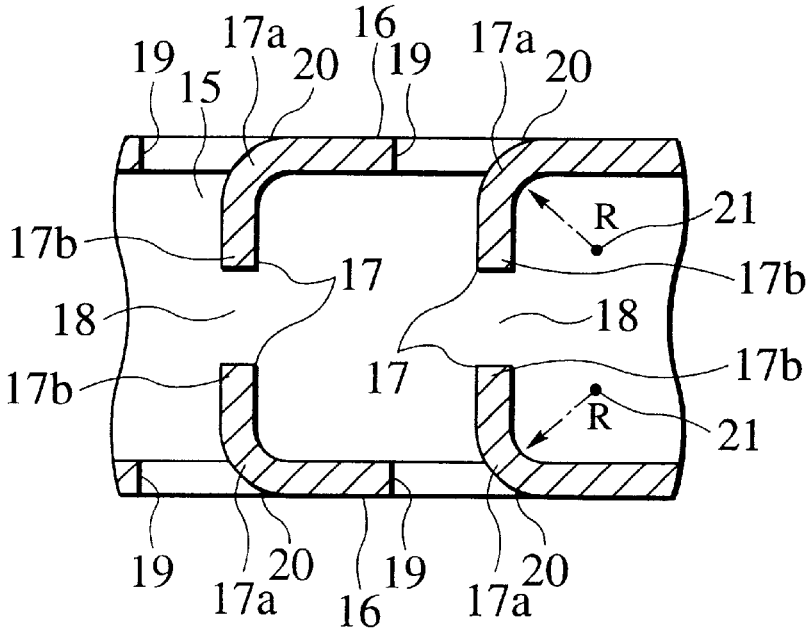
FIG. 2 is a plan view that shows the bending of the pressure contact blades in the first embodiment of the present invention.
Figure 3:
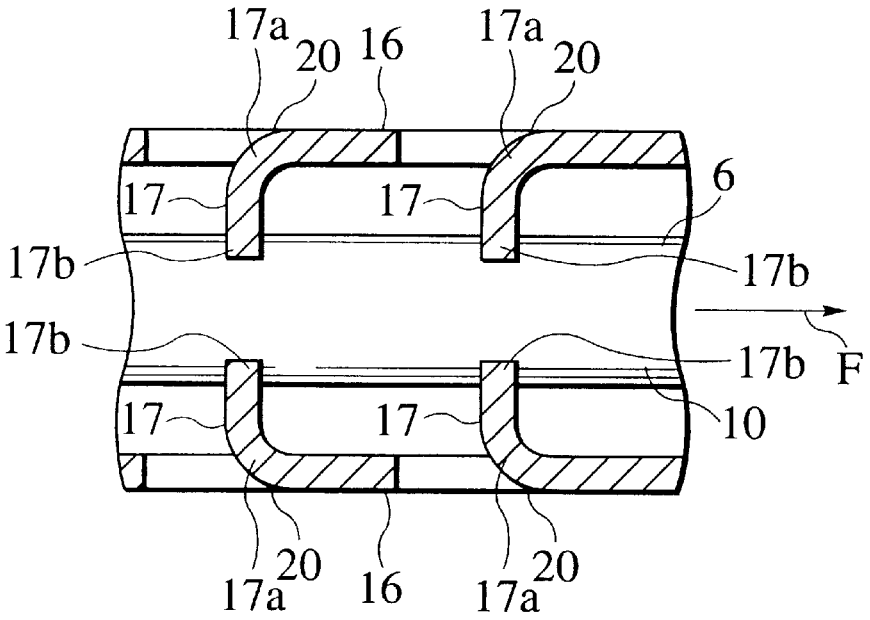
FIG. 3 is a plan view that shows the condition in which a pulling force acts upon the insulated wire.

FIG. 1 through FIG. 3 shows the first embodiment of an insulation displacement contact terminal according to the present invention. FIG. 1 is a perspective view of the overall insulation displacement contact terminal 11. The insulation displacement contact terminal 11 is formed by performing punching and press operations on a conductive metal sheet, so as to achieve the shape that is shown in FIG. 1. This insulation displacement contact terminal 11 has a contact part 12, a pressure contact part 13 that continuous after the contact part 12, a crimping part 14 that continues after the pressure contact part 13. The contact part 12, the pressure contact part 13, and the crimping part 14 are formed on the bottom wall part 15 along the longitudinal direction of the insulated wire 6.

The contact part 12 is formed as a squared tube, having at its end a hole 12*a* for the insertion of a mating contact. By inserting a mating contact from the insertion hole 12*a*, connection is made between the contact part 12 and the mating contact.

The crimping part 14 is formed by a pair of crimping pieces that protrude from the bottom wall 15. The crimping pieces are bent so as to crimp them, thereby holding the insulated wire 6 in the insulation displacement contact terminal 11.

The pressure contact part 13 is formed by a pair of side walls 16 and a plurality of pairs (two pairs in the case of this embodiment) of pressure contact blades 17 which are mutually opposing and partially bent from the side walls 16. The side walls 16 protrude upward from both sides of the bottom wall 15 and are mutually opposing. When an insulated wire 6 is inserted between the side walls 16 from the top as shown in drawing, the pressure contact blades make pressure contact with the insulated wire 6.

The insulated wire 6 is made up of a core wire 8, which is made of a conductive metal wire, and an insulation part 10, which is made of an insulating synthetic resin.

The pressure contact blades 17, as shown in FIG. 1 and FIG. 2, are a pair of blades that are bent in a direction that brings them closer to each other at opposing positions along the pair of side walls 16, a slot 18 for making contact with the insulated wire 6 being defined between the edges 17*b* of these pressure contact blades. In this embodiment, there are two pairs of pressure contact blades 17 which are disposed along the longitudinal direction of the side walls 16. When pressure contact is made with the insulated wire 6, the edges 17*b* of the pairs of pressure contact blades 17, as shown in FIG. 3, bite into the insulation part 10 of the insulated wire, thereby making electrical contact with the core wire 8 therewithin.

Each of the pressure contact blades 17 is formed by making a cutout in the side wall 16 and bending the side wall 16 from the cutout 19 in the direction that moves the pressure contact blade to be formed closer to the opposing pressure contact blade on the opposing side wall 16. The end part 20 of the cutout (boundary between the pressure contact blade and the side wall 16) is provided at a distal end of the cutout from the contact part 12. The pressure contact blades 17 are formed from the end parts of the cutouts. The edges 17*b* of each of the pressure contact blades 17 are disposed closer to the contact part 12 than the contact part 20.

The pressure contact blades 17 have a curved part 17*a* having a radius of curvature R, the center of which is the center of bending 21 (refer to FIG. 2). The curved part 17*a* curves outward toward the insulated wire 6. The radius of curvature R of the curved part 17*a* is established as a value that achieves relief of stress during and after bending.

A copper alloy is used as the material of the insulation displacement contact terminal 11, and with the thickness of this material being 0.25 mm and the top-to-bottom length of the pressure contact blades being 2 mm, a suitable radius of curvature R is 0.6 mm or greater but not exceeding 1.0 mm, a more preferable radius of curvature being 0.8 mm or greater but not exceeding 1.0 mm.

According to the above-described configuration, because the curved parts 17*a* relieves a concentration of stress when bending is done, bending is facilitated. The result of this is that there is no loss of strength due to bending. Additionally, because it is not necessary to make a bend at a right angle to the side wall 16, it being sufficient to have a gentle curvature, cracks do not develop, and this also prevents a loss of strength.

Additionally, because the curved part 17*a* relieves the concentration of stress after bending, when a pulling force F in the direction of the arrow shown in FIG. 3 (that is, in the direction opposite from the contact part 12) acts on the insulated wire 6 so that the pressure contact blades 17 become deformed, the increase in the width of the slot 18 is limited.

Additionally, because the edges 17*b* of each of the pressure contact blades 17 are disposed closer to the contact part 22 than the end parts 20 of the cutouts, when a pulling force F acts on the insulated wire 6, the edges 17*b* of the pressure contact blades move closer to each other than in the initial condition.

Thus, in addition to an improvement in the holding force of the pressure contact blades 17 on the insulated wire 6, a strong contact force is maintained between the pressure contact blades 17 and the inner core wire 8 within the insulated wire 6, thereby achieving a reliable connection condition.

Another advantage of the above-noted embodiment is the simple construction of the pressure contact blades 17 and the ease of bending the pressure contact blades 17.

Figure 4:
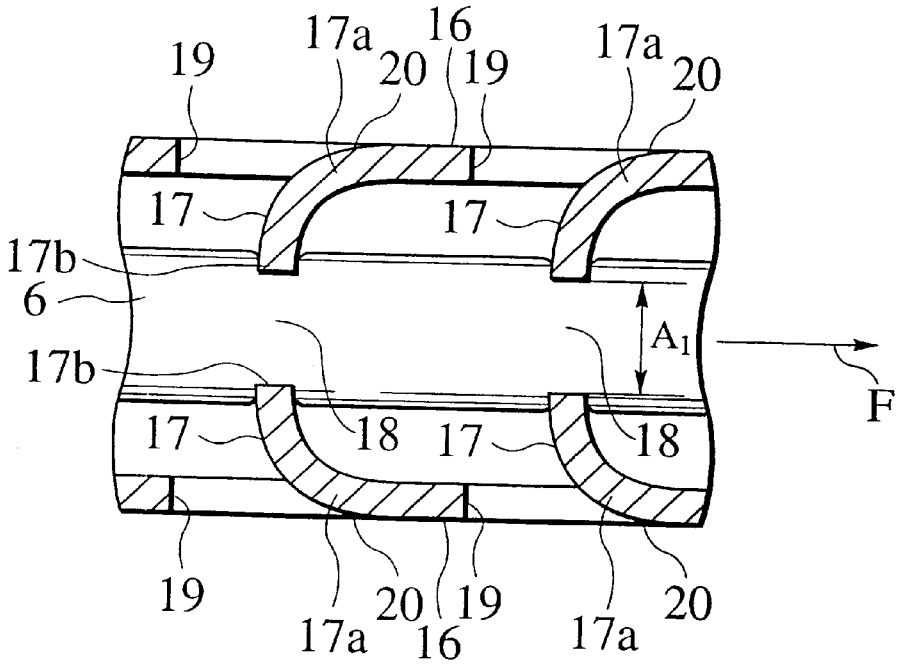
FIG. 4 is a plan view of another embodiment of the present invention.
Figure 5:
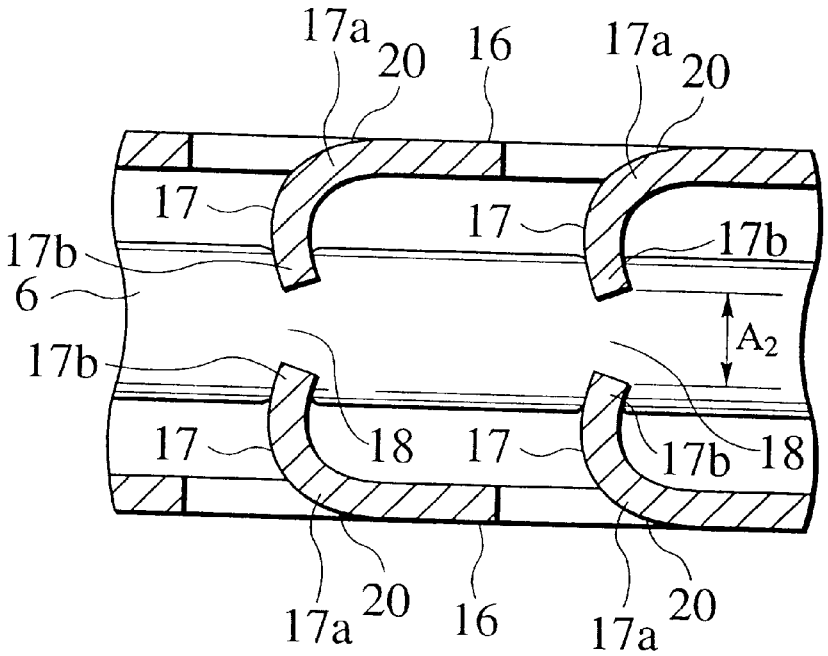
FIG. 5 is a plan view that shows the condition in which a pulling force acts on the insulated wire in the other embodiment of the present invention.

FIG. 4 and FIG. 5 show a second embodiment of the present invention, in which elements that correspond to those in the above-described first embodiment have been assigned the reference numerals as were used in the first-described embodiment.

In this embodiment, the pressure contact blades 17 have a radius of curvature of the curved part 17 that is larger than that of the first embodiment. In addition, the portion of the pressure contact blades that is taken up by the curved part 17*a* is greater than in the previous embodiment, the curved part 17*a* occupying almost the entire range of the pressure contact blade 17.

In this second embodiment, when a pulling force acts on the insulated wire 6, the condition in which the edges 17*b* move together being as described in more detail below.

When an insulated wire 6 is pressed into contact with the pressure contact blades 17, the width of the slot 18 between the opposing edges 17*b*, as shown in FIG. 4, is A1. After the pressure contact is made to the insulated wire 6, when a pulling force F acts on the insulated wire 6, the pressure contact blades 17 deform, so that opposing edges 17*a* thereof move toward each other. For this reason, as shown in FIG. 5, the width of the slot 18 becomes A2, where A2 is smaller than A1.

Because the width of slot 18 is reduced in this manner, the pressure contact blades 17 bite even deeper into the insulated wire, the result being not only an improvement in the holding force of the pressure contact blades 17 on the insulated wire 6, but also the maintenance of a strong contact force between the pressure contact blades 17 and the core wire 8 within the insulated wire 6, thereby achieving a reliable connection condition.

What is claimed is:

1. An insulation displacement contact terminal for electrical connection to an insulated wire having a core wire and an insulation covering for the core wire, the insulation displacement contact terminal comprising:

a pair of spaced apart side walls;

a pair of opposed pressure contact blades extending inwardly from the side walls and having mutually facing free ends, each of the pressure contact blades having a curved portion joined at a tangent end continuous with the side wall, the free ends of the contact blades biting into the insulated wire when inserted in a first direction between the pressure contact blades and make contact with the core wire, thereby imparting bending stress along the curved portions, each curved portion having a center of curvature, located so that a pulling force applied to the insulated wire in a second direction that intersects with the first direction relieves the bending stress along said curved portion, said second direction corresponding to a direction from said free end to said center of curvature.

2. An insulation displacement contact terminal according to claim 1, wherein each curved portion has a substantially uniform radius of curvature.

3. An insulation displacement contact terminal according to claim 1, wherein the free ends are disposed close to the curved portions.

4. An insulation displacement contact terminal according to claim 1, wherein the tangent ends are more forward in the second direction than the free ends.

5. An insulation displacement contact terminal according to claim 1, wherein the curved portions protrude from the tangent ends in a direction opposite to the second direction.

6. An insulation displacement contact terminal according to claim 1, wherein the center of the curvature of the curved portion is more forward in the second direction than the free end.

7. An insulation displacement contact terminal according to claim 1, wherein the bending stress is at the tangent end of the curved portion.

8. An insulation displacement contact terminal for electrical connection to an insulated wire having a core wire and an insulation covering the core wire, the insulation displacement contact terminal comprising:

a contact part that makes contact with a mating contact;

a pair of spaced apart side walls; and a pair of opposing pressure contact blades extending inwardly from the side walls and having mutually facing free ends, each of the contact blades having an end portion where the contact blade extends from the side wall, each end portion being disposed further from the contact part than the free end being disposed from the contact part, the free ends of the pressure contact blades biting into the insulation covering of the insulated wire when the insulated wire is inserted between the pressure contact blades and make contact with the core wire, thereby imparting bending stress along the pressure contact blades.

9. An insulation displacement contact terminal according to claim 8, wherein each pressure contact blade has a curved portion joined tangentially at the end portion, the curved portion having a center of curvature positioned so that a pulling force applied to the insulated wire in a direction away from the contact part relieves the bending stress along the contact blade.

10. An insulation displacement contact terminal according to claim 9, wherein each curved portion has a substantially uniform radius of curvature.

11. An insulation displacement contact terminal according to claim 9, wherein the free ends are disposed close to the curved portions.

12. An insulation displacement contact terminal according to claim 9, wherein the curved portions protrude from the end portions in a direction toward the contact part.

13. An insulation displacement contact terminal according to claim 9, wherein the center of the curvature of each curved portion being disposed in a direction opposite from the contact part with respect to the end portion of the contact blade.

14. An insulation displacement contact terminal according to claim 9, wherein the center of curvature of each curved portion being disposed in a direction opposite from the contact part with respect to the free end.

15. An insulation displacement contact terminal according to claim 9, wherein the bending stress is at the end portion of the contact blade.

* * * * *

UNITED STATES PATENT AND TRADEMARK OFFICE

CERTIFICATE OF CORRECTION

PATENT NO. : 6,155,865
DATED : December 5, 2000
INVENTOR(S) : Kimihiro Abe

It is certified that error appears in the above-identified patent and that said Letters Patent is hereby corrected as shown below:

Title page,
Item [57], ABSTRACT, line 2, "an a pair" should read -- and a pair --.

Signed and Sealed this

Ninth Day of April, 2002

*Attest:*

*Attesting Officer*

JAMES E. ROGAN
*Director of the United States Patent and Trademark Office*